US005080193A

United States Patent [19]

Woof

[11] Patent Number: 5,080,193

[45] Date of Patent: Jan. 14, 1992

[54] IMPROVED HUNTER'S LADDER STAND

[76] Inventor: Philip L. Woof, Route 4, Box 132C, Black River Falls, Wis. 54615

[21] Appl. No.: 645,697

[22] Filed: Jan. 25, 1991

[51] Int. Cl.[5] ..... E06C 7/08; E06C 7/50

[52] U.S. Cl. ..... 182/116; 182/194; 182/228; 182/178

[58] Field of Search ..... 182/194, 217, 219, 228, 182/187, 188, 116, 93, 178

[56] References Cited

U.S. PATENT DOCUMENTS

| | | | |
|---|---|---|---|
| 502,967 | 8/1893 | Rowe | 182/217 |
| 834,653 | 10/1906 | Barrett | 182/217 |
| 1,952,878 | 3/1934 | Marschutz | 182/194 |
| 2,385,171 | 9/1945 | Vaiden | 182/217 |
| 3,220,766 | 11/1965 | Kates | 182/116 |
| 4,535,871 | 8/1985 | Lapeyre | 182/194 |
| 4,552,247 | 11/1985 | Purdy | 182/116 |
| 4,991,690 | 2/1991 | Woller | 182/194 |

*Primary Examiner*—Reinaldo P. Machado
*Attorney, Agent, or Firm*—H. Jay Spiegel

[57] ABSTRACT

An improved hunter's ladder stand includes irregularly shaped legs and rungs which provide structure that blends into an outdoor environment comprising irregularly shaped trees, branches and shrubs. The irregular shape of the hunter's stand provides less distraction for wild animals in sports such as hunting. The hunter's ladder stand also may include a seat portion and a stand portion to permit a hunter to sit or stand while using the hunter's ladder stand.

7 Claims, 2 Drawing Sheets

IMPROVED HUNTER'S LADDER STAND

BACKGROUND OF THE INVENTION

The present invention relates to an improved hunter's ladder stand. The present invention includes a ladder stand which includes irregular lines and shapes which permit the ladder stand to blend into a hunting environment. Firstly, ladder stands for use in hunting are known. Furthermore, climbing structures such as ladders or playground structures having different shapes are known. Design U.S. Pat. No. D230,503 to Emmons discloses a foldable ladder having a curved leg therewith. Design U.S. Pat. No. D236,518 to Wormser discloses a playground structure having an oblique climbing structure therewith. However, Applicant is unaware of any prior art, including the two patents cited above, which teaches or fairly suggests a hunter's ladder stand which includes irregularly shaped legs as well as ladder rungs.

SUMMARY OF THE INVENTION

The present invention relates to an improved hunter's ladder stand. The present invention includes the following interrelated aspects and features:

A) In a first aspect, the improved hunter's ladder stand comprises a ladder structure, a seat portion, a standing portion and a means to secure the upper portion of the ladder stand to a vertical structure such as a tree.

B) The ladder structure includes a pair of legs and a plurality of rungs. The legs and rungs of the ladder structure are irregularly shaped to permit the improved hunter's ladder stand to blend into an outdoor environment.

C) The improved hunter's ladder stand may be made as one integral piece or be manufactured in any known manner such that the ladder stand may be folded in a compact manner to facilitate carrying the ladder stand over long distances.

Accordingly, it is a first object of the present invention to provide an improved hunter's ladder stand.

It is a further object of the present invention to provide an improved hunter's ladder stand which includes a ladder structure which is irregularly shaped so as to blend into an outdoor environment.

It is a still further object of the present invention to provide an improved hunter's ladder stand that is foldable for easy storage and transportation.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
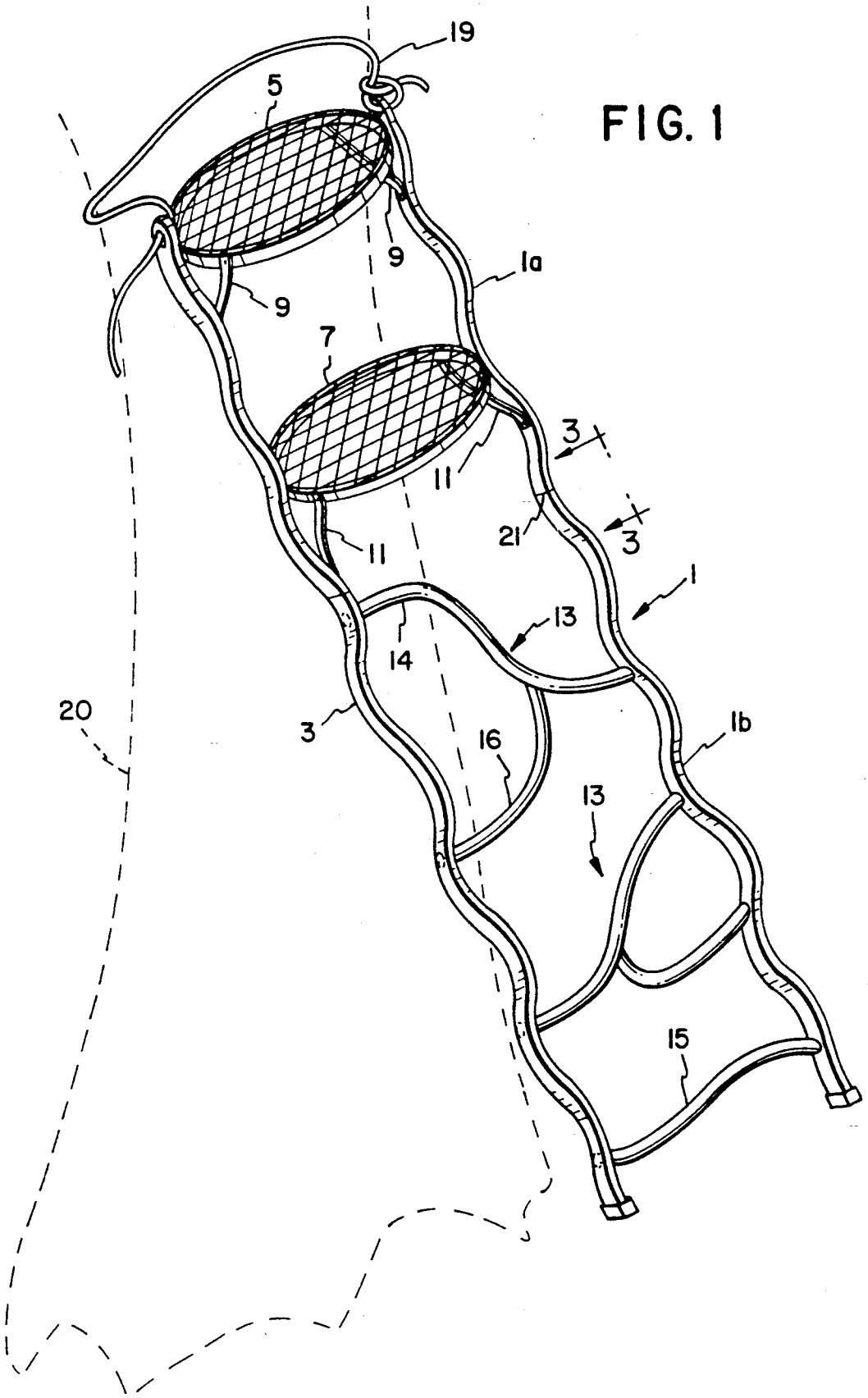
FIG. 1 shows a perspective view of the inventive hunter's ladder stand in an exemplary use.

With reference to FIG. 1 firstly, the improved hunter's ladder stand is generally designated by the reference numeral 10 and is seen to include ladder legs 1 and 3, a seat portion 5 and a stand portion 7. The seat portion 5 is attached to the legs 1 and 3 and includes support members 9 therewith to further stabilize the seat. The stand portion 7 includes support legs 11 which are attached to the legs 1 and 3 in a similar manner as that described for the legs 9 of the seat 5.

The improved hunter's ladder stand also includes a plurality of irregularly shaped rungs. A first type of irregularly shaped rung is depicted as reference numeral 13 which includes a first curved portion 14 and a second curved portion 16. A second type of irregularly shaped rung is designated by the reference numeral 15. It should be understood that the rungs 13 and 15 are attached to the ladder legs 1 and 3 in any known manner. Furthermore, the rung portion 16 is connected to the rung portion 14 by conventional fastening means. It should be understood that any irregular shape may be used for the legs and rungs besides the types shown in the drawings.

With reference to FIG. 1 again, the improved hunter's ladder stand also includes a rope 19 which facilitates securing the ladder stand to the tree 20. Of course, other securing means may be utilized to secure the ladder stand to an existing vertical or horizontal structure.

Figure 2:
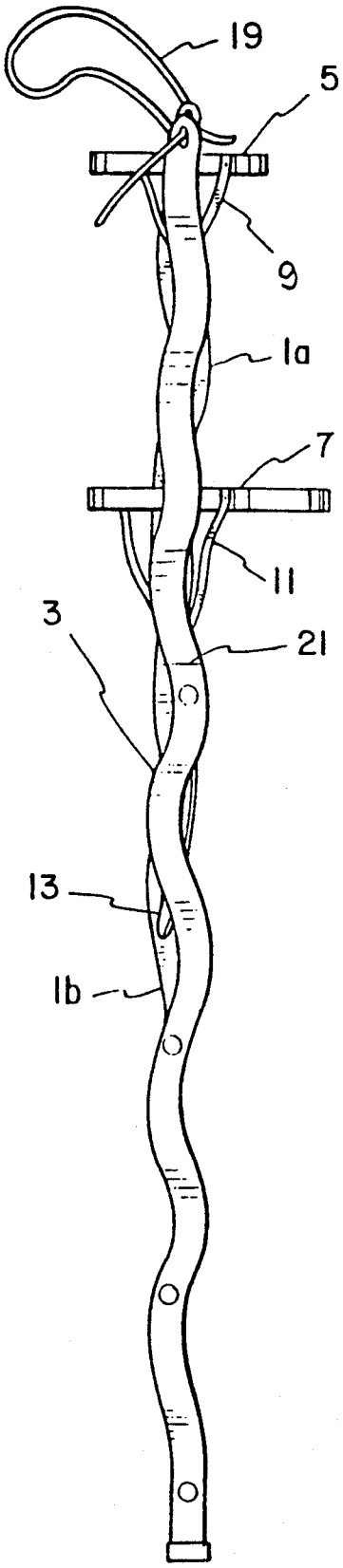
FIG. 2 shows a side view of the hunter's ladder stand.

With reference to FIG. 2, a side view of the ladder stand is depicted which more clearly illustrates the irregular shape of the ladder structure.

Figure 3:
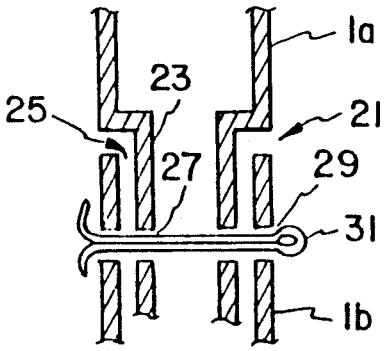
FIG. 3 shows a cross-sectional view along the line III—III of FIG. 1.

The improved hunter's ladder stand includes a junction 21 on the legs 1 and 3 to facilitate breaking down the ladder stand to permit carrying over long distances. FIG. 3 shows one embodiment of a manner in which the improved hunter's ladder stand may be broken down for storage or transportation. As can be seen from FIG. 3, the ladder leg 1 is divided into two sections 1*a* and 1*b*. The section 1*a* includes a male end 23 which is designed to be inserted into the opening 25 of the ladder section 1*b*. The male end 23 includes a through opening 27 therein which is designed to be aligned with the through opening 29 in the ladder section 1*b*. A cotter pin 31 may be inserted through the openings 27 and 29 to firmly attach together the ladder sections 1*a* and 1*b*. Of course, other means may be utilized to permit the ladder stand to be folded or broken down such as pivoting means or the like.

The improved hunter's ladder stand may be made out of any material with a preferred material being either fiberglass or aluminum. Although the ladder legs 1 and 3 are rectangular in cross-section, ladder legs having an H-shaped or any other usable cross-section may also be utilized for the inventive device. Furthermore, the circular rungs 13 and 15 depicted in FIG. 1 may be replaced with rungs having a rectangular or square cross-section.

The improved hunter's ladder stand provides improvements over other prior art hunter's stands by providing a structure using irregular lines and shapes that will blend into an outdoor environment so as to cause less distraction to wild animals. Typical ladder designs include straight lines and ninety-degree cross bars which stand out against the irregular shape of trees and branches found in an outdoor environment.

As such, an invention has been disclosed in terms of a preferred embodiment thereof which fulfills each and every one of the objects of the invention as set forth hereinabove and provides a new and improved hunter's ladder stand of great novelty and utility.

Of course, various changes, modifications and alterations in the teachings of the present invention may be contemplated by those skilled in the art without departing from the intended spirit and scope thereof. As such, it is intended that the present invention only be limited by the terms of the appended claims.

I claim:

1. An improved hunter's ladder stand comprising:

a) a pair of ladder legs, each said leg having an irregular shape which includes bends and curves; and b) a plurality of rungs, each rung having an irregular shape which includes bends and curves;

c) whereby said ladder legs and said rungs provide an irregularly shaped structure which provides improved camouflage for a user by blending into an outdoor environment.

2. The invention of claim 1, wherein said ladder stand further includes a first platform for seating a user.

3. The invention of claim 2, wherein said ladder stand further includes a second platform to permit a user to stand thereon.

4. The invention of claim 1, wherein said ladder stand further includes means to secure said ladder stand to an adjacent structure.

5. The invention of claim 4, wherein said means to secure said ladder stand comprises a rope tie.

6. The invention of claim 1, wherein said ladder legs include means to break down said ladder legs to facilitate storage and transportation of said ladder stand.

7. The invention of claim 1, wherein said ladder stand is made out of aluminum or fiberglass.

* * * * *